US008393858B2

(12) United States Patent
Smoke et al.

(10) Patent No.: US 8,393,858 B2
(45) Date of Patent: Mar. 12, 2013

(54) TURBINE SHROUD SUPPORT COUPLING ASSEMBLY

(75) Inventors: Jason Smoke, Phoenix, AZ (US); Michael Kahrs, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 931 days.

(21) Appl. No.: 12/403,765

(22) Filed: Mar. 13, 2009

(65) Prior Publication Data

US 2010/0232941 A1 Sep. 16, 2010

(51) Int. Cl.
*F01D 5/20* (2006.01)

(52) U.S. Cl. ..... 415/173.3; 415/156

(58) Field of Classification Search ..... 415/156, 415/159, 160, 173.3
See application file for complete search history.

(56) References Cited

U.S. PATENT DOCUMENTS

| | | | | |
|---|---|---|---|---|
| 4,130,375 | A * | 12/1978 | Korta | 415/161 |
| 4,669,955 | A | 6/1987 | Pellow | |
| 5,947,243 | A * | 9/1999 | MacDonald | 192/3.29 |
| 6,113,349 | A | 9/2000 | Bagepalli et al. | |
| 6,726,448 | B2 | 4/2004 | McGrath et al. | |
| 6,758,653 | B2 | 7/2004 | Morrison | |
| 6,779,971 | B2 * | 8/2004 | Garrett | 415/156 |
| 6,932,566 | B2 | 8/2005 | Suzumura et al. | |
| 7,044,709 | B2 | 5/2006 | Bruce et al. | |
| 7,195,452 | B2 * | 3/2007 | Allan et al. | 415/135 |
| 7,406,826 | B2 * | 8/2008 | Hayashi et al. | 60/602 |
| 7,434,670 | B2 | 10/2008 | Good et al. | |
| 2007/0009350 | A1 * | 1/2007 | Tothill | 415/170.1 |
| 2007/0248425 | A1 * | 10/2007 | Andersson et al. | 407/113 |

* cited by examiner

*Primary Examiner* — Caridad Everhart
(74) *Attorney, Agent, or Firm* — Ingrassia Fisher & Lorenz, P.C.

(57) ABSTRACT

A coupling assembly for a turbine shroud is provided. The coupling assembly comprises a rotatable positioning block having a first surface, and a biasing spring having a second surface, the second surface generally facing the first surface, and the biasing spring adapted to exert a force toward the positioning block when compressed.

18 Claims, 6 Drawing Sheets

TURBINE SHROUD SUPPORT COUPLING ASSEMBLY

STATEMENT REGARDING FEDERALLY SPONSORED RESEARCH OR DEVELOPMENT

This invention was made with Government support under contract number W911W6-08-2-0001 awarded by the United States Department of Defense. The Government has certain rights in the invention.

TECHNICAL FIELD

Embodiments of the subject matter described herein relate generally to turbine engine shrouds. More particularly, embodiments of the subject matter relate to engagements between turbine engine shrouds and turbine engine shroud supports.

BACKGROUND

Turbine engines, as well as other turbomachinery systems, benefit from confining and controlling the flowpath of heated gases. When heated gas passes across the turbine blades, work is extracted from the heated gas. Accordingly, the efficiency of the turbine engine is directly dependent on the proportion of heated gas passing across the turbine blades. It is desirable to increase the efficiency to produce more power from a given amount of fuel.

One way heated gases can flow around turbine blades, rather than across them, is by traveling through a radial gap. The radial gap is a space which exists between the tip of turbine blades and the surrounding shroud. A shroud is typically used to surround the turbine blades, confining the hot gases to the flowpath. The shroud is, in turn, supported by a support structure, and the two are coupled together. In addition to metals, ceramics can be used to form certain shrouds and shroud components. Unfortunately, ceramics and metals typically have different thermal expansion properties. As a result, when the turbine is operating at high temperatures, if a shroud and shroud support are composed of the dissimilar materials—such as a ceramic shroud with a metal shroud support, the shroud and shroud support tend to expand or grow at different rates. This can result in specific spacing requirements to accommodate the dissimilar growth rates.

Additionally, tolerances inherent in the manufacture of the components also introduce spacing requirements into the engagement. Both spacing requirements are typically addressed by adding space for clearance in the coupling arrangement between the shroud and shroud support. The increased space in the coupling arrangement, in turn, increases the size of the radial gap between the turbine blades and the shroud. Consequently, the efficiency of the engine is reduced. It would be beneficial to use a coupling assembly which can accommodate different expansion rates among the components without requiring an increase in the size of the radial gap. Additionally, it would be advantageous to use a coupling assembly which minimizes contributions to the radial gap size by the spacing required to accommodate manufacturing tolerances.

BRIEF SUMMARY

A coupling assembly for a turbine shroud is provided. The coupling assembly comprises a rotatable positioning block having a first surface, and a biasing spring having a second surface, the second surface generally facing the first surface, and the biasing spring adapted to exert a force toward the positioning block when compressed.

A turbine shroud support device is also provided. The turbine shroud support device comprises an annular support ring surrounding a central point, the support ring having a coupling face, and an engagement clip coupled to the coupling face. The engagement clip comprises a stop having a first surface disposed in a plane transverse to the coupling face, the first surface having a first edge positioned radially inward toward the central point and a second edge opposite the first edge, the second edge positioned radially outward from the central point, and a biasing member having a second surface disposed in a plane transverse to the coupling face, the second surface having a third edge positioned radially inward toward the central point and a fourth edge opposite the third edge, the fourth edge positioned radially outward from the central point, the biasing member adapted to exert a forward toward the first surface when compressed.

Another coupling assembly for a turbine shroud support is provided. The coupling assembly comprises a stop block comprising a first face, the stop block coupled to the turbine shroud support, and a positioning spring coupled to the turbine shroud support, comprising a contact surface positioned toward the first face, the positioning spring adapted to bias the contact surface toward the first face.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Figure 4:
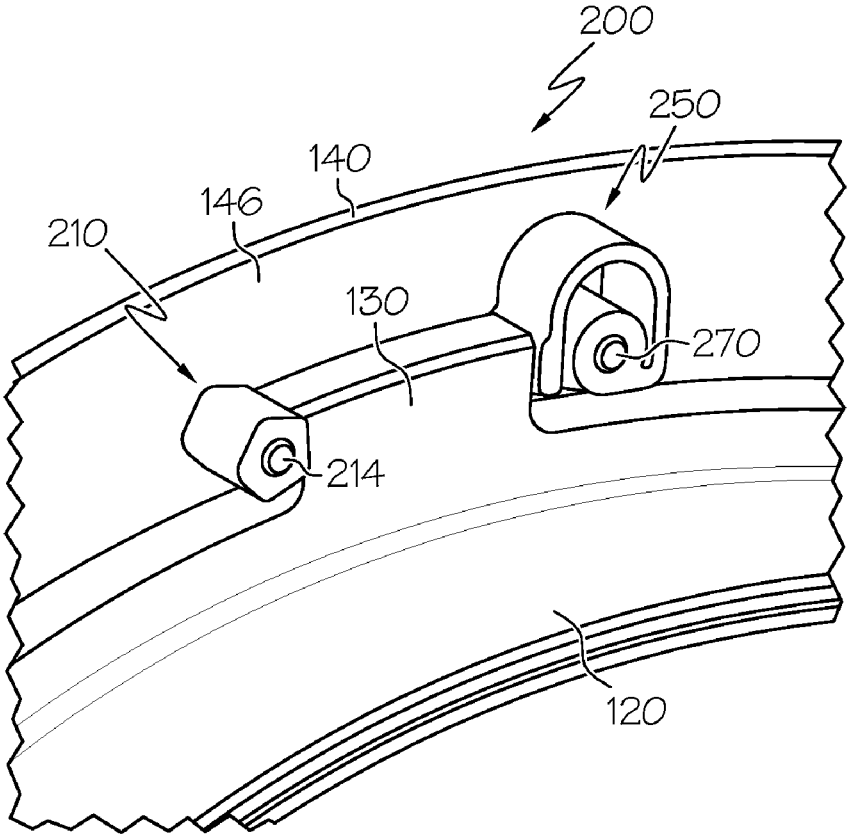
FIG. 4 is a detailed perspective view of an embodiment of a turbine shroud coupling assembly.

"Coupled"—The following description refers to elements or nodes or features being "coupled" together. As used herein, unless expressly stated otherwise, "coupled" means that one element/node/feature is directly or indirectly joined to (or directly or indirectly communicates with) another element/node/feature, and not necessarily mechanically. Thus, although the schematic shown in FIG. 4 depicts one exemplary arrangement of elements, additional intervening elements, devices, features, or components may be present in an embodiment of the depicted subject matter.

"Adjust"—Some elements, components, and/or features are described as being adjustable or adjusted. As used herein, unless expressly stated otherwise, "adjust" means to position, modify, alter, or dispose an element or component or portion thereof as suitable to the circumstance and embodiment. In certain cases, the element or component, or portion thereof, can remain in an unchanged position, state, and/or condition as a result of adjustment, if appropriate or desirable for the embodiment under the circumstances. In some cases, the element or component can be altered, changed, or modified to a new position, state, and/or condition as a result of adjustment, if appropriate or desired.

"Inhibit"—As used herein, inhibit is used to describe a reducing or minimizing effect. When a component or feature is described as inhibiting an action, motion, or condition it may completely prevent the result or outcome or future state completely. Additionally, "inhibit" can also refer to a reduction or lessening of the outcome, performance, and/or effect which might otherwise occur. Accordingly, when a component, element, or feature is referred to as inhibiting a result or state, it need not completely prevent or eliminate the result or state.

In addition, certain terminology may also be used in the following description for the purpose of reference only, and thus are not intended to be limiting. For example, terms such as "upper", "lower", "above", and "below" refer to directions in the drawings to which reference is made. Such terminology may include the words specifically mentioned above, derivatives thereof, and words of similar import. Similarly, the terms "first", "second", and other such numerical terms referring to structures do not imply a sequence or order unless clearly indicated by the context.

In the preferred embodiments described below, a spring and positioning block can be coupled to a turbine shroud support component. A tab or protrusion of the turbine shroud can extend between the spring and positioning block and be held in place by them. The spring and positioning block preferably contact the tab over an area on a surface to prevent edge or point loads. Preferably, the tab can have a slanted sidewalls engaged with the surfaces. The surfaces can have a complementary slant, resulting in unrestrained expansion of the components during dissimilar thermal expansion.

Figure 1:
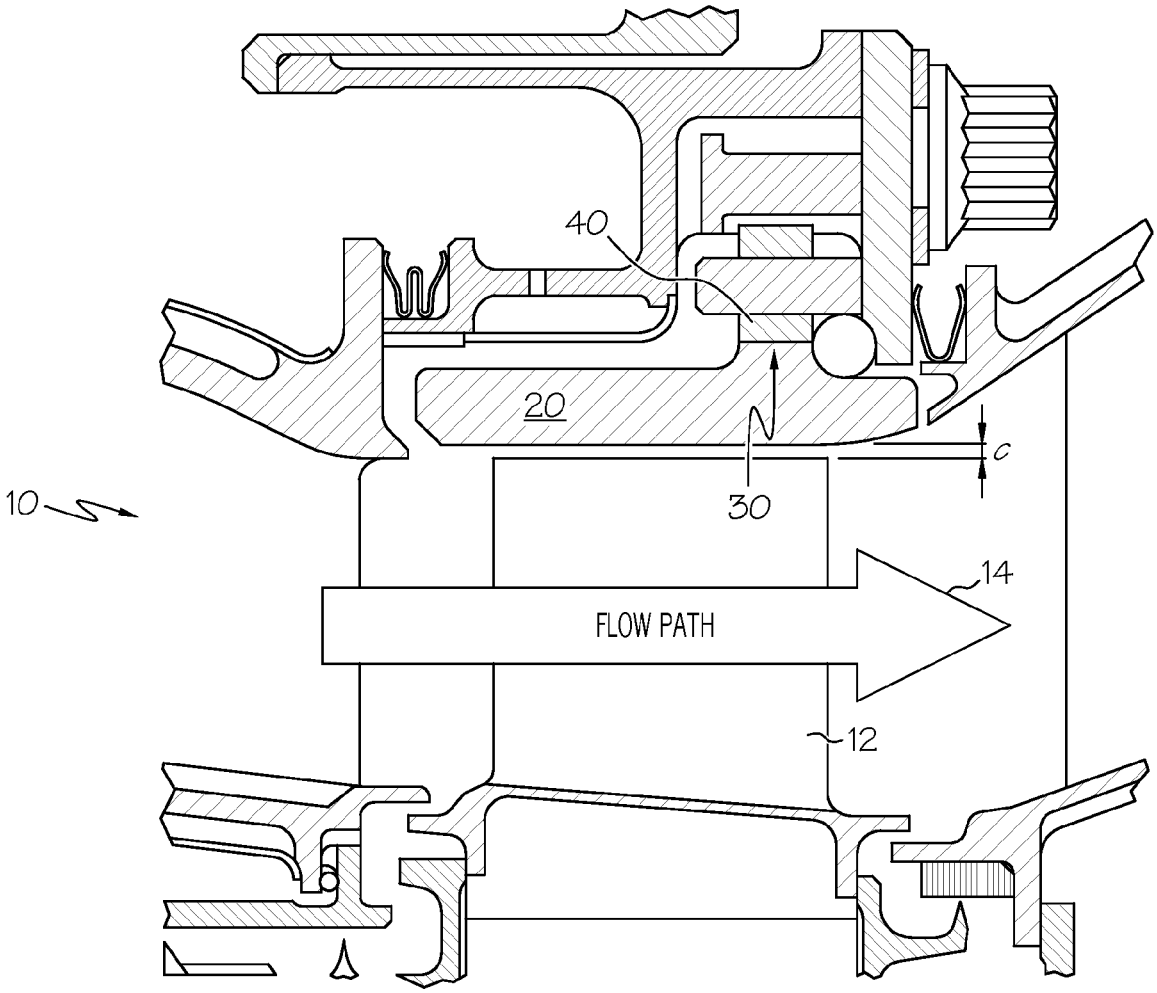
FIG. 1 is a cross-sectional view of an embodiment of a turbine engine.

FIG. 1 illustrates an embodiment of a flowpath of a turbine engine 10 implementing several features of the prior art. Although certain features of embodiments are described in the context of a turbine engine, it should be understood that different turbomachinery applications can be used in other embodiments. For example, air cycle machines, auxiliary power units, starter turbomachines, and the like can employ one or more embodiments of the coupling assemblies described below. Thus, although a turbine engine is used for context, embodiments can be present in any device which includes a turbine shroud coupled to a shroud support assembly.

The turbine engine 10 includes a turbine blade airfoil 12, against which a heated gas is directed in a flowpath 14. The turbine blade airfoil 12 is surrounded by an annular, circular ring-shaped turbine shroud 20. The turbine blade airfoil 12 passes within the shroud 20 by a clearance c. The shroud comprises one or more tabs 30, which are engaged with the shroud support 40. The shroud support 40 can include a variety of different components and structures. One such component is a second annular, circular ring surrounding the shroud 20. The shroud support 40 can provide engagement sites for coupling between the shroud 20 and the shroud support 40, thereby coupling the shroud 20 to the rest of the support structures.

Figure 2:
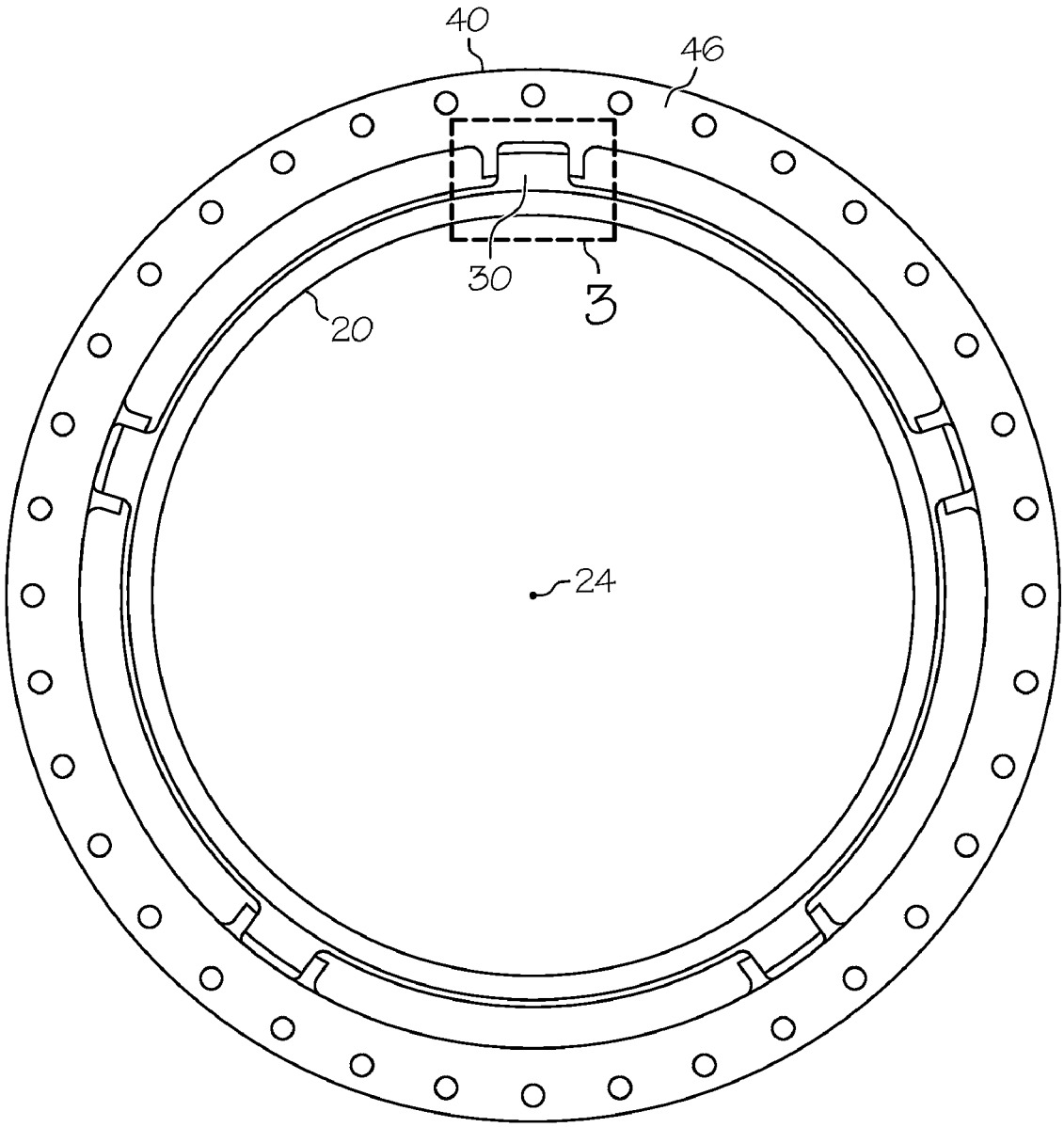
FIG. 2 (PRIOR ART)
FIG. 2 is front view of a turbine shroud and turbine shroud support from the embodiment of FIG. 1.

FIG. 2 illustrates a front view of the shroud 20 and shroud support 40. Other components are omitted for clarity. As illustrated the shroud 20 and shroud support 40 are both preferably circular in one dimension, and surround a common central point 24. As can be seen, a plurality of tabs 30 can extend radially outward from the shroud 20 around the circumference of the shroud 20. The shroud support 40 has a coupling face 46. For descriptive purposes, only one tab 30 and coupling to the shroud support 40 is described in detail. Other engagement sites, such as the five shown here, or any other number, can be substantially the same as the described site, replicated in different positions on the shroud support 40 for each of the tabs 30.

Figure 3:
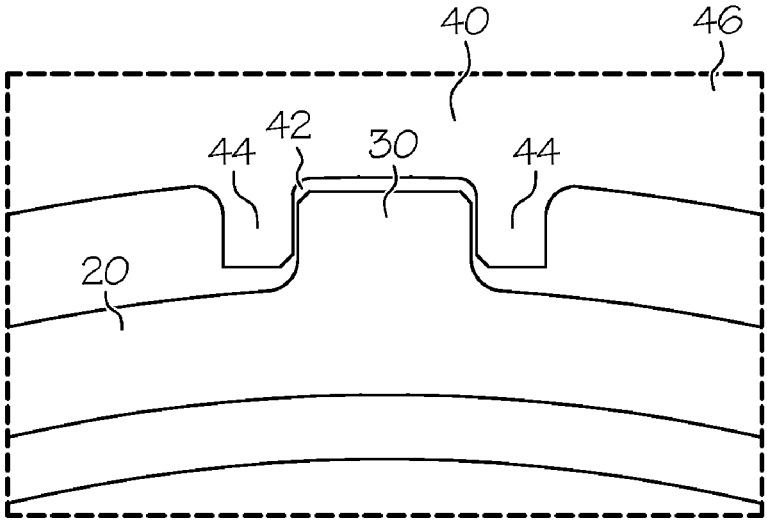
FIG. 3 (PRIOR ART)
FIG. 3 is a detailed view of an engagement site of FIG. 2.

FIG. 3 illustrates a detailed view of a prior art engagement site. As can be seen, the tab 30 extends into an alcove 42 of the shroud support 40 formed between two inward projections 44. The sidewalls of the projections 44 are parallel, confining the tab 30. Among other drawbacks, the tab 30 is free to rotate between the projections 44, caused by space between the sidewalls of the tab 30 and the sidewalls of the projections 44.

FIG. 4 illustrates a detailed view of an embodiment of an engagement clip or coupling assembly 200 for the shroud support 140. The coupling assembly 200 comprises a positioning block 210 and a biasing member 250. Both the positioning block 210 and biasing member 250 are coupled to a face 146 of the shroud support 140. Unless otherwise specified, numerical indicators in FIGS. 4-8 indicate components that are substantially similar to previous components, except that the indicator has been incremented by 100.

Figure 5:
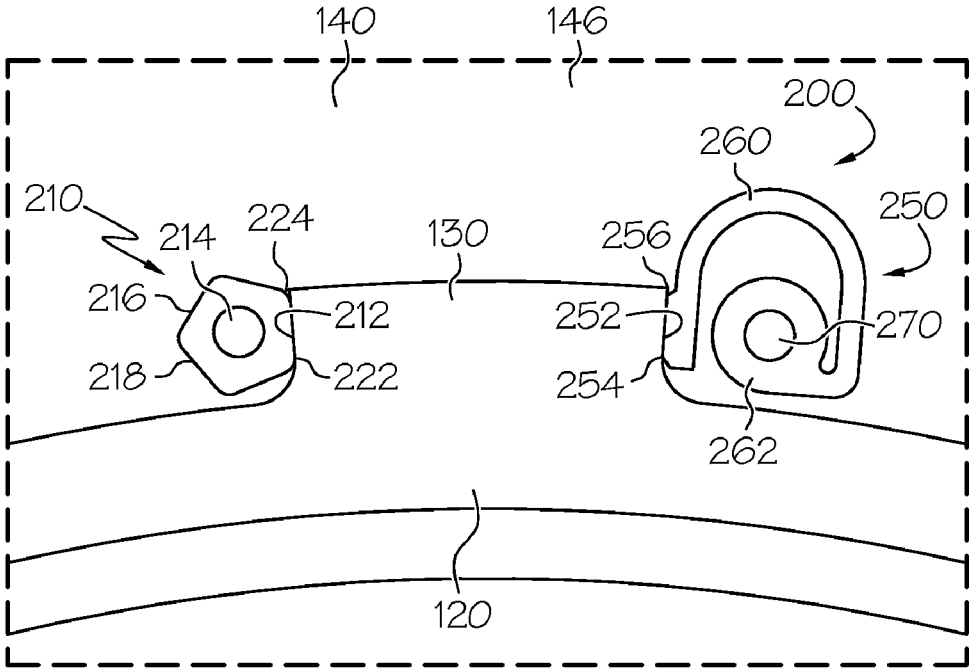
FIG. 5 is a detailed front view of the embodiment of FIG. 4.
Figure 6:
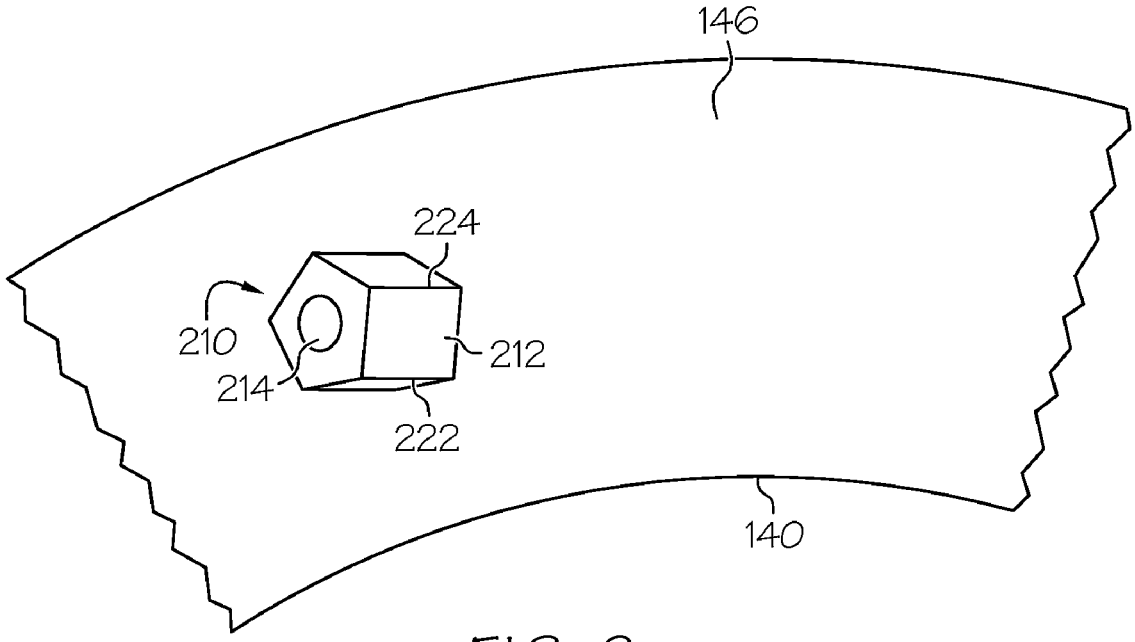
FIG. 6 is a detailed perspective view of a portion of the embodiment of FIG. 4.
Figure 7:
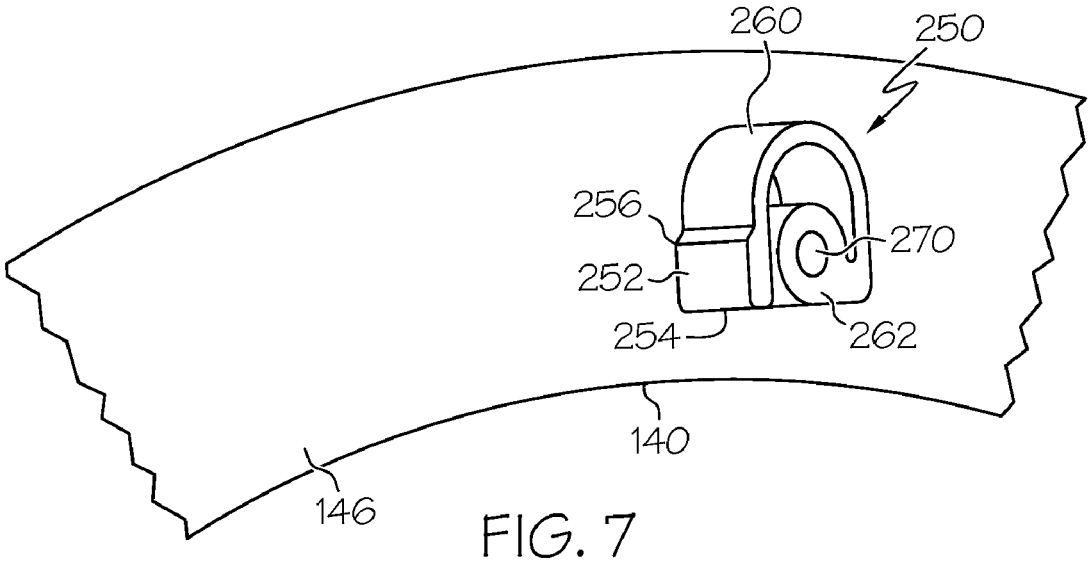
FIG. 7 is a detailed perspective view of another portion of the embodiment of FIG. 4.

With additional reference to FIGS. 5-7, the biasing clip, engagement clip, engagement assembly, or coupling assembly 200 and interaction with tab 130 are now described. FIG. 5 illustrates a front view of the embodiment of FIG. 4. FIG. 6 illustrates a perspective view of the positioning block 210 with the tab 130 omitted. Similarly, FIG. 7 illustrates a perspective view of the biasing member 250 with the tab 130 omitted. The tab 130 extends between the positioning block 210 and biasing member 250. The positioning block 210 is an object having a surface 212 and coupled to the shroud support 140 by a pin 214. The positioning block 210 can have other surfaces, such as surfaces 216 and 218. The positioning block 210 can have a regular geometric shape, such as the pentagonal shape illustrated, or other shapes, if desired. For example, square or quadrilateral shapes, as well as triangular or octagonal shapes can be used in certain embodiments.

The positioning block 210 can be composed of a metal, such as a nickel- or cobalt-based superalloy. Preferably, the positioning block 210 is composed of a material having a low coefficient of friction as used. Thus, the tab 130 can preferably slide along the contacting surface 212 of the positioning block 210 without significant impediment from friction from the surface 212 during thermal expansion. Other materials can be used as well, if appropriate for the embodiment. While the positioning block 210 is illustrated as a single, integral component surrounding the pin 214, in other embodiments, the positioning block 210 can be composed of multiple subcomponents fastened, welded, brazed, bonded, or otherwise coupled through an appropriate technique. The positioning block 210 can be referred to as a stop block, insofar as it provides a stop against which the tab 130 rests when biased by the biasing member 250.

The surface 212 is preferably substantially flat, although imperfections and variations from perfect flatness are present in certain embodiments. Although described as flat to indicate the lack of surface features, such as ridges, dimpling, and so on, the surface 212 can have a radius of curvature, if desired. Certain embodiments of the surface 212 can have a large radius, resulting in a partially rounded surface. The rounding profile can be circular, elliptical, or any other shape. The radius can result in localized deformation to create a contact zone, thereby inhibiting point or line loading on the surface 212.

The surface 212 has a lower edge 222 and an upper edge 224 along opposite edges. The lower edge 222 is closer to the central point of the shroud 120 and/or shroud support 140 than the upper edge 224, sometimes described as radially inward toward the central point. The upper edge 224, by contrast, is farther from the central point of the shroud 120 and/or shroud support 140, and can be described as radially outward from the central point. Although shown with a quadrilateral shape, other shapes are possible for the surface 212, depending on the overall configuration of surfaces along the perimeter of the positioning block 210.

The pin 214 preferably couples the positioning block 210 to the shroud support 140. The shroud support 140 can have a flat surface facing toward the positioning block 210 and biasing member 250. The flat surface is referred to as the coupling face 146, and is the surface or face of the shroud support 140 to which the positioning block 210 and biasing member 250 are pinned, as well as the surface against which the tabs 130 are positioned. The pin 214 can be composed of the same material as the positioning block 210, or any other suitable material, particularly a high-strength metal, including metals which maintain their strength at high temperatures. Preferably, the surface 212 is disposed in a plane transverse, including perpendicular, to the coupling face 146.

Preferably, the positioning block 210 is rotatable around the pin 214. Accordingly, while surface 212 is depicted proximate to, and contacting, the tab 130, other contact or contacting faces or surfaces 216, 218 can be rotated into a contact position as well. In some embodiments, the positioning block 210 can be freely rotatable, and restrained in a position by contact with the tab 130. In other embodiments, the positioning block 210 can be secured in position by tightening the pin 214, engaging a locking mechanism, or other technique.

The additional surfaces 216, 218 of the positioning block 210 can have features similar to those described with respect to surface 212. Thus, when rotated into position to engage the tab 130, any contacting surface will have an upper and lower edge corresponding to the described lower and upper edges 222, 224 of the embodiment as described. Although shown in a regular geometric shape, in different embodiments, the different surfaces 212, 216, 218 of the positioning block 210 can have different distances from the pin 214, or center of the positioning block 210. Thus, by rotating some embodiments of the positioning block 210, the tab 130 can be engaged a different distance from the center of the pin 214, resulting in an adjustment in the distance between the surface 212 and surface 252 of the biasing member 250. Accordingly, different widths of tabs 130 can be accommodated by rotating the positioning block 210.

The biasing member 250 can comprise a surface 252, a biasing or resilient portion 260, a static central portion 262, and a pin 270. Preferably, the biasing member 250 is configured to exert a force toward the surface 212 of the positioning block 210 when compressed. Accordingly, the biasing member 250 comprises the surface 252 for contacting the tab 130, the static central portion 262, and a resilient portion 260 causing the bias towards the surface 212.

The surface 252 is preferably substantially flat, and has lower edge 254 and upper edge 256. The surface 252 can have many of the features previously described with respect to surface 212, including positioning of the lower edge 254 closer to the central point of the shroud 120 and/or shroud support 140 than the upper edge 256. Thus, as before, the lower edge 254 is radially inward toward the central point, whereas the upper edge 256 is radially outward from the central point, relative to each other. Although shown with a substantially quadrilateral shape, other shapes can also be used. Preferably, the surface 252 is free from features which would cause line or point contact between the surface 252 and a sidewall of a tab 130.

Figure 9:
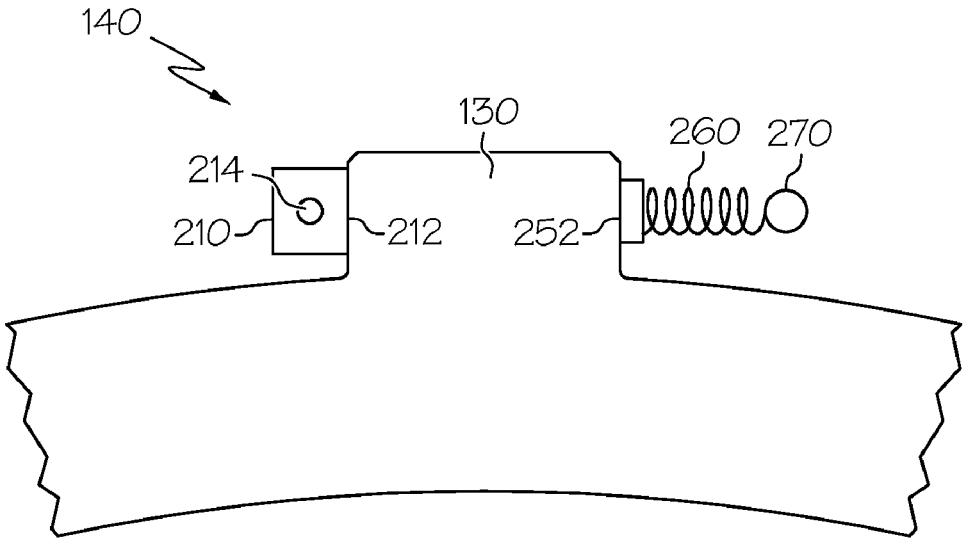
FIG. 9 is a detailed front view of another embodiment of a turbine shroud coupling assembly.
Figure 8:
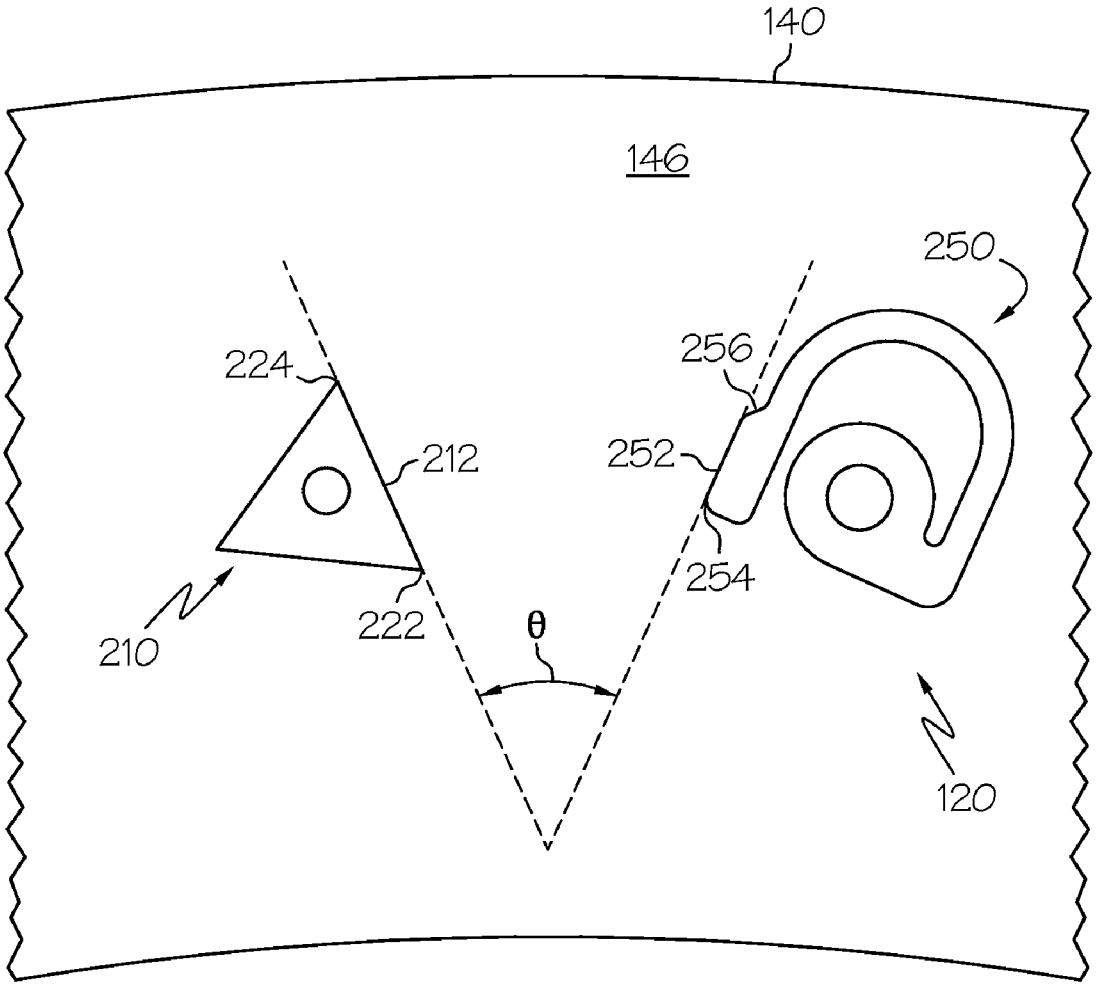
FIG. 8 is a front view of an embodiment of a coupling assembly.

The resilient portion 260 can comprise a curved or arc-shaped member of the illustrated embodiment, or, in other embodiments, can have different shapes. The resilient portion 260 can be referred to as a biasing portion, resilient spring, positioning spring, and so on, without deviating from the embodiments described herein. As shown, the resilient portion 260 is preferably coupled to the surface 252, such as by being integrally-formed, or through affixation, bonding, fasteners, and so on. The resilient portion 260 is preferably biased to maintain the surface 252 in a desired position. Thus, if the surface 252 is displaced toward the pin 270 by the tab 130, the resilient portion 260 exerts a force to restore the surface 252 to the undisplaced position. Thus, while the arc-shaped resilient portion 260 is shown, other embodiments of the resilient members can be used in different embodiments of the coupling assembly 200. For example, in some embodiments, the resilient member can be a linear spring, such as a helical spring, while in others, a torsional spring can be used. Other spring types and shapes can also be used. FIG. 8 illustrates an exemplary embodiment where a linear spring serves as the resilient portion 260. Other embodiments can also be formed through combinations of features described with respect to the positioning block and biasing member 250. For example, some embodiments of the resilient portion 260 can include a coil, such as the spring illustrated in FIG. 9, while others do not.

The static central portion 262 can be coupled to the resilient portion 260 and coupled to the shroud support 140 by the pin 270. Other embodiments can include or omit the static central portion 262 as useful to position the surface 252 with the resilient portion 260. In those embodiments with a static central portion 262 and arc-shaped resilient portion 260, the resilient portion 260 can extend at least partially around the static central portion 262 to couple with the surface 252. In those embodiments with spiral springs, the resilient member can completely surround the static central portion 262 and/or pin 270.

The biasing member 250 can be a single unit coupled to the shroud support 140 by the pin 270, as shown. In such embodiments, the various subcomponents, such as the surface 252, resilient portion 260, and static central portion 262 can be integrally-formed. In other embodiments, some or all of the components can be formed separately, and later coupled through any appropriate fastening, bonding, welding, brazing, or interference technique. Preferably, the components of the biasing member 250 are formed from the same material as the positioning block 210 for ease of manufacture, although dissimilar materials can also be used. Preferably, however, the surface 252 has a low friction coefficient, as explained above with reference to surface 212.

In certain embodiments, the positioning block 210 and/or biasing member 250 can be coupled to the coupling face 146 of the shroud support 140 by a technique other than pins. For example, in certain embodiments, they can be bolted, or in some embodiments, some or all of the respective components can be integrally formed with the shroud support 140. The biasing member 250 is preferably coupled to the shroud support 140 such that the surface 252 is positioned transverse, including perpendicular, to the coupling face 146, as shown.

Preferably, the coupling assembly 200 is engaged with a tab 130 having non-parallel sidewalls. Dissimilar thermal expansion of the tab 130 and coupling assembly 200 can cause separation therebetween as the shroud support 140 expands at a greater rate than the tab 130. The positioning block 210 and biasing member 250 can have expanded positions resulting in increased distance between them. In those embodiments where the tab 130 is composed of a material, such as a ceramic, which expands at a slower rate than the shroud support 140 and/or coupling assembly 200, the tab 130 may not expand at the same rate, and consequently, some distance between the sidewalls of the tab 130 and the contact surfaces 212, 252 can appear.

FIG. 8 illustrates an alternative embodiment of the shroud 120 and coupling assembly 200 exaggerated to show the angle θ between the surfaces 212, 252. To avoid this separation, the tab 130 is preferably shaped to increase in width as the distance from the center of the shroud 120 increases. When the tab 130 has slanted sidewalls, as shown in FIG. 8, and the positioning block 210 and biasing member 250 have a complementary slant in contact surfaces 212, 252, contact between the coupling assembly 200 and tab 130 can be maintained during dissimilar thermal expansion. Accordingly, slanted sidewalls are preferred to maintain contact between the shroud 120 and shroud support 140.

Thus, as shown in FIGS. 4 and 5, the tab 130 can have slanted sidewalls which increase the width of the tab 130 the farther it protrudes from the shroud 120. Some embodiments of the tab 130 can have sidewalls which slant the other direction, decreasing the width of the tab 130 as it extends from the shroud 120. The amount of slant of the sidewalls of the tab 130 can vary between embodiments, but is preferably configured as shown, with the sidewalls disposed slanted towards the central point of the shroud 120, rather than away from the central point.

The surfaces 212, 252 contacting the tab 130, are therefore preferably nonparallel. In terms of the previously described features, the lower edges 222, 254 are preferably parallel, and closer than the upper edges 224, 256. In this way, the surfaces 212, 252 can be slanted in a direction complementary to the sidewalls of the tab 130. Thus, as the tab 130 or coupling assembly 200 thermally expands, the low-friction contact surfaces 212, 252 preferably slide along the sidewalls of the tab 130 while maintaining contact with the tab 130.

In those embodiments of the resilient portion 260 where a spring is used, the spring preferably directs the force in a direction corresponding to the surface 252. Thus, the force or bias imparted by the resilient portion 260 is preferably directed perpendicular to the sidewall of the tab 130, and not necessarily linearly toward the surface 212 of the positioning block 210.

In addition to the rotatable features previously described, the positions of the positioning block 210 and/or biasing member 250 can be altered by engaging the pins 214, 270 in different locations on the coupling face 146 of the shroud support 140. Thus, while one position is shown for each, multiple pin positions can be present on the shroud support 140, and the pins 214, 270 can be place in positions desired for engagement of the coupling assembly 200 with the tab 130.

By using a resilient biasing member 250, contact can be made with two surfaces at all times, reducing the play in the engagement between the tab 130 and shroud support 140. Additionally, through the use of the rotatable positioning block 210 and repositionable pinned components, play due to tolerances for manufacturing and assembly can also be minimized or inhibited. Accordingly, the shroud 120 can be more accurately positioned, reducing the clearance c required. By reducing the clearance c, efficiency of the turbine engine 100 can be improved.

While one coupling assembly 200 is shown, multiple coupling assemblies can be present around the shroud support 140 for engaging a plurality of tabs 130. Additionally, the same embodiment of coupling assembly can be used for each engagement, or multiple different embodiments can be present on a single shroud support 140.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A coupling assembly for a turbine shroud, the coupling assembly comprising:

a rotatable positioning block having a first surface; and a biasing spring having a second surface, the second surface generally facing the first surface, and the biasing spring adapted to exert a force toward the positioning block when compressed, wherein the positioning block further comprises a plurality of surfaces, the positioning block rotatable such that the first surface or any of the plurality of surfaces can be positioned generally facing the second surface.

2. The coupling assembly of claim 1, wherein the positioning block further comprises a pin and the positioning block is adapted to rotate around the pin.

3. The coupling assembly of claim 1, wherein the first and second surfaces are substantially flat.

4. The coupling assembly of claim 1, wherein the biasing spring comprises a coil.

5. The coupling assembly of claim 1, wherein the biasing spring comprises a resilient portion having an arc, the second surface coupled to the resilient portion.

6. The coupling assembly of claim 5, wherein the biasing spring further comprises a static central portion, the resilient portion coupled to the static central portion, and the arc at least partially surrounding the static central portion.

7. A turbine shroud support device comprising:

an annular support ring surrounding a central point, the support ring having a coupling face; and an engagement clip coupled to the coupling face, the engagement clip comprising:

a stop having a first surface disposed in a plane transverse to the coupling face, the first surface having a first edge positioned radially inward toward the central point and a second edge opposite the first edge, the second edge positioned radially outward from the central point; and a biasing member having a second surface disposed in a plane transverse to the coupling face, the second surface having a third edge positioned radially inward toward the central point and a fourth edge opposite the third edge, the fourth edge positioned radially outward from the central point, the biasing member adapted to exert a forward toward the first surface when compressed.

8. The turbine shroud support device of claim 7, wherein the first and third edges of the engagement clip are parallel and closer together than the second and fourth edges of the engagement clip.

9. The turbine shroud support device of claim 7, wherein the stop further comprises a pin coupled to the annular support ring, the stop rotatable around the pin.

10. The turbine shroud support device of claim 7, wherein the biasing member comprises a nickel-based superalloy.

11. The turbine shroud support device of claim 7, wherein the biasing member comprises a resilient member coupled to the second surface.

12. The turbine shroud support device of claim 11, wherein the resilient member comprises a linear spring.

13. The turbine shroud support device of claim 11, wherein the resilient member comprises a curved portion coupled to the second surface, the curved portion adapted to bias the second surface toward the first surface.

14. A coupling assembly for a turbine shroud support, the coupling assembly comprising:

a stop block comprising a first face, a second face, and a center, the first and second faces located a different distance from the center, the stop block coupled to the turbine shroud support; and a positioning spring coupled to the turbine shroud support, comprising a contact surface positioned toward the first face, the positioning spring adapted to bias the contact surface toward the first face.

15. The coupling assembly of claim 14, wherein the positioning spring comprises a helical spring.

16. The coupling assembly of claim 14, wherein the positioning spring comprises a torsional spring.

17. The coupling assembly of claim 14, wherein the stop block further comprises a pin coupled to the turbine shroud support, and the stop block is rotatable around the pin.

18. The coupling assembly of claim 17, wherein the stop block has a regular geometric shape.

* * * * *